US012000223B2

(12) United States Patent
Marsala et al.

(10) Patent No.: US 12,000,223 B2
(45) Date of Patent: Jun. 4, 2024

(54) GEOSTEERING IN DIRECTIONAL DRILLING

(71) Applicants: Saudi Arabian Oil Company, Dhahran (SA); Openfield Technology, Versailles (FR)

(72) Inventors: Alberto F. Marsala, Dhahran (SA); Eric Donzier, Versailles (FR); Emmanuel Tavernier, Versailles (FR); Linda Abbassi, Versailles (FR)

(73) Assignees: Openfield Technology, Versailles (FR); Saudi Arabian Oil Company, Dhahran (SA)

( * ) Notice: Subject to any disclaimer, the term of this patent is extended or adjusted under 35 U.S.C. 154(b) by 323 days.

(21) Appl. No.: 17/290,049

(22) PCT Filed: May 26, 2020

(86) PCT No.: PCT/IB2020/000532
§ 371 (c)(1),
(2) Date: Apr. 29, 2021

(87) PCT Pub. No.: WO2021/240197
PCT Pub. Date: Dec. 2, 2021

(65) Prior Publication Data

US 2022/0307337 A1 Sep. 29, 2022

(51) Int. Cl.
*E21B 21/08* (2006.01)
*E21B 7/04* (2006.01)
(Continued)

(52) U.S. Cl.
CPC ..... *E21B 21/085* (2020.05); *E21B 7/04* (2013.01); *E21B 44/00* (2013.01); *E21B 47/07* (2020.05);
(Continued)

(58) Field of Classification Search
CPC ..... E21B 21/085; E21B 47/107; E21B 47/07; E21B 47/13; E21B 47/18; E21B 7/04; E21B 44/00; E21B 49/08
See application file for complete search history.

(56) References Cited

U.S. PATENT DOCUMENTS 3,292,143 A 12/1966 Russell
4,676,313 A 6/1987 Rinaldi
(Continued)

FOREIGN PATENT DOCUMENTS

CA 2851237 5/2013
CA 2856274 3/2016
(Continued)

OTHER PUBLICATIONS

Marsala et al., "First Borehole to Surface Electromagnetic Survey in KSA: reservoir mapping & monitoring at a new scale", SPE 146348-PP, Society of Petroleum Engineers (SPE), presented at the SPE Annual Technical Conference and Exhibition, Oct. 30-Nov. 2, 2011, 10 pages.

(Continued)

*Primary Examiner* — Dany E Akakpo
(74) *Attorney, Agent, or Firm* — Fish & Richardson P.C.

(57) ABSTRACT

A method and system are geosteering in coiled tubing directional drilling. In an exemplary method, a response from a gas sensor disposed on a bottom hole assembly is measured and a gas parameter from the response is determined. A trend in the gas parameter is determined. Adjustments to geosteering vectors for the bottom hole assembly are determined based, at least in part, on the gas parameter, the trend, or both.

21 Claims, 5 Drawing Sheets

(51) Int. Cl.

| | |
|---|---|
| ***E21B 44/00*** | (2006.01) |
| ***E21B 47/07*** | (2012.01) |
| ***E21B 47/107*** | (2012.01) |
| ***E21B 47/13*** | (2012.01) |
| ***E21B 47/18*** | (2012.01) |
| ***E21B 49/08*** | (2006.01) |

(52) U.S. Cl.

CPC ..... *E21B 47/107* (2020.05); *E21B 49/08* (2013.01); *E21B 47/13* (2020.05); *E21B 47/18* (2013.01)

(56) References Cited

U.S. PATENT DOCUMENTS 5,128,901 A 7/1992 Drumheller
5,151,658 A 9/1992 Muramatsu et al.
5,176,207 A 1/1993 Keller
5,753,812 A 5/1998 Aron
5,854,991 A 12/1998 Gupta et al.
5,876,645 A 3/1999 Johnson
5,877,995 A 3/1999 Thompson
5,886,303 A 3/1999 Rodney
6,026,900 A 2/2000 Keller
6,283,209 B1 9/2001 Keller
6,739,165 B1 5/2004 Strack
6,740,141 B2 5/2004 Espin et al.
7,093,672 B2 8/2006 Seydoux et al.
7,376,517 B2 5/2008 Rickett
7,595,737 B2 9/2009 Fink et al.
7,721,803 B2 5/2010 Huang et al.
7,913,806 B2 3/2011 Pabon
7,937,222 B2 5/2011 Donadille et al.
7,991,555 B2 8/2011 Yang et al.
8,069,913 B2 12/2011 Coste
8,090,538 B2 1/2012 Wilkinson et al.
8,101,907 B2 1/2012 Jacobi et al.
8,168,570 B2 5/2012 Barron et al.
8,215,384 B2 7/2012 Trinh
8,230,918 B2 7/2012 Ameen
8,253,417 B2 8/2012 Pislak et al.
8,269,501 B2 9/2012 Schmidt et al.
8,347,985 B2 1/2013 Bittar
8,424,377 B2 4/2013 Keller
8,627,902 B2 1/2014 Hammer
8,664,586 B2 3/2014 Schmidt
8,680,866 B2 3/2014 Marsala et al.
8,714,246 B2 5/2014 Pop et al.
8,726,983 B2 5/2014 Khan
8,803,077 B2 8/2014 Schmidt
8,812,237 B2 8/2014 Wilt et al.
8,931,347 B2 1/2015 Donzier et al.
8,976,625 B2 3/2015 Bilas
8,997,868 B2 4/2015 Nguyen et al.
9,002,649 B2 4/2015 Bittar
9,080,097 B2 7/2015 Gupta et al.
9,128,203 B2 9/2015 Al-Dossary et al.
9,260,957 B2 2/2016 Commarieu et al.
9,274,249 B2 3/2016 Thorne
9,366,099 B2 6/2016 Ly
9,405,033 B2 8/2016 Marsala et al.
9,494,033 B2 11/2016 Taherian et al.
9,557,434 B2 1/2017 Keller et al.
9,611,736 B2 4/2017 Marsala et al.
9,644,472 B2 5/2017 Fuhst et al.
9,651,700 B2 5/2017 Marsala et al.
9,689,253 B2 6/2017 Rivero
9,696,450 B2 7/2017 Marsala et al.
9,733,191 B2 8/2017 Bittar et al.
9,863,244 B2 1/2018 Donzier et al.
9,952,192 B2 4/2018 Donzier et al.
9,983,328 B2 5/2018 Marsala et al.
10,030,486 B1 7/2018 Keller
10,095,983 B1 10/2018 Venter et al.
10,125,546 B2 11/2018 Wu et al.
10,125,586 B2 11/2018 Balan et al.
10,132,952 B2 11/2018 Marsala et al.
10,145,975 B2 12/2018 Marsala et al.
10,156,654 B2 12/2018 Marsala et al.
10,254,430 B2 4/2019 Fang et al.
10,267,943 B2 4/2019 Marsala et al.
10,288,755 B2 5/2019 Cordery
10,294,771 B2 5/2019 Donzier et al.
10,472,951 B2 11/2019 Donzier et al.
10,527,751 B2 1/2020 Donzier et al.
10,570,716 B2 2/2020 Balan et al.
10,612,360 B2 4/2020 Al-Qasim et al.
10,677,034 B2 6/2020 Balan et al.
10,677,035 B2 6/2020 Balan et al.
10,808,529 B2 10/2020 Ow et al.
10,968,737 B2 4/2021 Marsala
2001/0017163 A1 8/2001 Penza
2004/0108110 A1 6/2004 Zupanick et al.
2004/0246141 A1 12/2004 Tubel et al.
2005/0034917 A1 2/2005 Mathiszik et al.
2005/0078555 A1 4/2005 Tang et al.
2005/0252286 A1 11/2005 Ibrahim et al.
2006/0044940 A1 3/2006 Hall et al.
2006/0104578 A1 5/2006 Herbst
2007/0256832 A1 11/2007 Hagiwara et al.
2008/0066960 A1 3/2008 Mathiszik
2008/0257546 A1 10/2008 Cresswell et al.
2008/0290874 A1 11/2008 Seleznev et al.
2009/0033516 A1* 2/2009 Alteirac ..... E21B 47/12 340/853.2
2009/0087911 A1 4/2009 Rogerio
2009/0164188 A1 6/2009 Habashy
2009/0288820 A1 11/2009 Barron et al.
2010/0109672 A1 5/2010 Rabinovich et al.
2010/0132448 A1 6/2010 Donadille et al.
2010/0198519 A1 8/2010 Wilt et al.
2010/0200248 A1 8/2010 Kriesels et al.
2010/0296100 A1 11/2010 Blacklaw
2011/0042083 A1 2/2011 Sierra et al.
2011/0088895 A1 4/2011 Pop et al.
2011/0309835 A1 12/2011 Barber et al.
2012/0016649 A1 1/2012 Thambynayagam et al.
2012/0062886 A1 3/2012 Piotti et al.
2012/0111561 A1* 5/2012 Frey ..... E21B 47/10 166/250.03
2012/0178653 A1 7/2012 McClung, III
2012/0253680 A1 10/2012 Thompson
2012/0268135 A1 10/2012 Marsala et al.
2012/0325465 A1 12/2012 Hammer et al.
2013/0091941 A1 4/2013 Huh
2014/0041862 A1 2/2014 Ersoz
2014/0180592 A1 6/2014 Ravi
2014/0180658 A1 6/2014 Rossi
2014/0203810 A1 7/2014 Marsala et al.
2014/0203811 A1 7/2014 Marsala et al.
2014/0208843 A1 7/2014 Godfrey
2014/0238670 A1 8/2014 Pop et al.
2014/0239957 A1 8/2014 Zhang et al.
2014/0361777 A1 12/2014 Marsala et al.
2015/0061683 A1 3/2015 Marsala et al.
2015/0061684 A1 3/2015 Marsala et al.
2015/0132543 A1 5/2015 Nouzille et al.
2015/0204993 A1 7/2015 Leggett, III et al.
2015/0232748 A1 8/2015 Kanj et al.
2015/0370934 A1 12/2015 Pride et al.
2016/0041286 A1* 2/2016 Sinha ..... G01F 1/74 73/152.32
2016/0041296 A1 2/2016 Ahmad et al.
2016/0138390 A1 5/2016 Arntsen
2016/0259079 A1 9/2016 Wilson
2016/0282881 A1 9/2016 Filippov
2016/0291194 A1 10/2016 Marsala et al.
2017/0059668 A1 3/2017 Chang et al.
2017/0314385 A1 11/2017 Hori et al.
2017/0351000 A1 12/2017 Marsala et al.
2018/0003027 A1* 1/2018 Donzier ..... E21B 47/10
2018/0066515 A1 3/2018 Marsala et al.
2018/0128937 A1 5/2018 Donzier et al.
2018/0275306 A1 9/2018 Marsala et al.
2018/0298752 A1 10/2018 Balan et al.

(56) References Cited

U.S. PATENT DOCUMENTS

| | | | |
|---|---|---|---|
| 2018/0320514 | A1 | 11/2018 | Felkl et al. |
| 2018/0347349 | A1 | 12/2018 | Marsala |
| 2019/0003291 | A1 | 1/2019 | Balan et al. |
| 2019/0003292 | A1 | 1/2019 | Balan et al. |
| 2019/0003303 | A1 | 1/2019 | Donzier et al. |
| 2019/0011593 | A1 | 1/2019 | Marsala et al. |
| 2019/0107643 | A1 | 4/2019 | Golmohammadizangabad et al. |
| 2019/0112899 | A1* | 4/2019 | Stone ..... E21B 43/36 |
| 2019/0169975 | A1 | 6/2019 | Al-Qasim et al. |
| 2019/0266501 | A1 | 8/2019 | Tavares |
| 2019/0293814 | A1 | 9/2019 | Horne |
| 2019/0339408 | A1 | 11/2019 | Davies |
| 2019/0368336 | A1 | 12/2019 | Hammond et al. |
| 2019/0376821 | A1 | 12/2019 | Donzier et al. |
| 2019/0391034 | A1 | 12/2019 | Al Jabri |
| 2020/0030777 | A1 | 1/2020 | Al-Jabri et al. |
| 2020/0031738 | A1 | 1/2020 | Al-Jabri et al. |
| 2020/0032148 | A1 | 1/2020 | Al-Jabri et al. |
| 2020/0034711 | A1 | 1/2020 | Misra et al. |
| 2020/0116019 | A1 | 4/2020 | Ow et al. |
| 2020/0208513 | A1 | 7/2020 | Al-Qasim et al. |
| 2020/0408089 | A1 | 12/2020 | Ow et al. |
| 2022/0307372 | A1 | 9/2022 | Marsala et al. |

FOREIGN PATENT DOCUMENTS

| | | |
|---|---|---|
| EP | 1803001 | 2/2012 |
| EP | 2966257 | 1/2016 |
| GB | 2489714 | 10/2012 |
| GB | 2563739 | 12/2018 |
| WO | WO 2005119303 | 12/2005 |
| WO | WO 2006059057 | 6/2006 |
| WO | WO 2010135584 | 11/2010 |
| WO | WO 2011129828 | 10/2011 |
| WO | WO 2012115717 | 8/2012 |
| WO | WO 2014051789 | 4/2014 |
| WO | WO 2014058425 | 4/2014 |
| WO | WO 2014060562 | 4/2014 |
| WO | WO 2014144917 | 9/2014 |
| WO | WO 2014207075 | 12/2014 |
| WO | WO 2015016932 | 2/2015 |
| WO | WO 2015027084 | 2/2015 |
| WO | WO 2015167935 | 11/2015 |
| WO | WO 2015187142 | 12/2015 |
| WO | WO 2015192226 | 12/2015 |
| WO | WO 2016200374 | 12/2016 |
| WO | WO 2018085504 | 5/2018 |
| WO | WO 2018234431 | 12/2018 |

OTHER PUBLICATIONS

Marsala et al., "Fluid Distribution Inter-Well Mapping in Multiple Reservoirs by Innovative Borehole to Surface Electromagnetic: Survey Design and Field Acquisition," IPTC-17045, presented at the International Petroleum Technology Conference (IPTC), Beijing, China, Mar. 26-28, 2013; 4 pages.

Mohaghegh et al., "A Methodological Approach for Reservoir Heterogeneity Characterization Using Artificial Neural Networks," SPE 28394, Society of Petroleum Engineers (SPE), presented at the SPE Annual Technical Conference & Exhibition held in New Orleans, LA, U.S.A., Sep. 25-28, 1994; Society of Petroleum Engineers, 1994, 5 pages.

Munn et al., "Novel cable coupling technique for improved shallow distributed acoustic sensor VSPs," Journal of Applied Geophysics 138, Mar. 2017, 8 pages.

Musyanovych et al., "Preparation of Biodegradable Polymer Nanoparticles by Miniemulsion Technique and Their Cell Interactions," Macromolecular Bioscience, Feb. 2008, 8(2):127-139, 13 pages.

openfield-technology.com [online] "Micro instruments for harsh environments" OpenField Technologies of Paris, France, available on or before Apr. 17, 2020, retrieved from <https://www.openfield-technology.com/>.

Poitzsch et al., "Nanoparticle Tags for Improved Depth Correlation," IPTC-19785, International Petroleum Technology Conference (IPTC), IPTC Conference 2020, 2 pages (abstract only).

Rafik et al., "Prediction of permeability and porosity from well log data using the nonparametric regression with multivariate analysis and neural network, Hassi R'Mel Field, Algeria," Egyptian Journal of Petroleum, 2017, 26: 763-778, 16 pages.

Rahmani et al., "Characterizing Reservoir Heterogeneities Using Magnetic Nanoparticles", SPE-173195-MS, Society of Petroleum Engineers (SPE), presented at the SPE Reservoir Simulation Symposium on Feb. 23-26, 2015, 29 pages.

Reisch et al., "Fluorescent Polymer Nanoparticles Based on Dyes: Seeking Brighter Tools for Bioimaging," Small, Apr. 2016, 12(15):1968-1992, 48 pages.

Rovetta et al., "Petrophysical Inversion of Resistivity Logging Data," SPE-184030-MS, Society of Petroleum Engineers (SPE), presented at the SPE Middle East Oil and Gas Show and Conference, Manama, Bahrain, Mar. 6-9, 2017, 13 pages.

Salehi et al., "Estimation of the non-records logs from existing logs using artificial neural networks," Egyptian Journal of Petroleum, 2017, 26: 957-968, 12 pages.

Santarelli et al., "Formation Evaluation From Logging on Cuttings," SPE Reservoir Evaluation and Engineering, presented at the 1996 SPE Permian Basin Oil and Gas Recovery Conference, Mar. 27-29, 1996, 7 pages.

Tang and Cheng, "A dynamic model for fluid flow in open borehole fractures," Journal of Geophysical Research: Solid Earth, 94, 7567-7576, Jun. 10, 1989, 10 pages.

Tatang et al., "An efficient method for parametric uncertainty analysis of numerical geophysical models," Journal of Geophysical Research, 102:D18 (925-21, 932), Sep. 27, 1997; pp. 21.

Tonn, "The determination of the seismic quality factor Q from VSP data: a comparison of different computational methods," Geophysical Prospecting, 39, 1991, 27 pages.

U.S. Appl. No. 62/513,822, Bakulin et al., Detecting Sub-Terranean Structures, filed Jun. 1, 2017, 34 pages.

Vandamme et al., "How the Invasion Zone Can Contribute to the Estimation of Petrophysical Properties from Log Inversion at Well Scale?" SPWLA 58th Annual Logging Symposium, SPWLA-2017-JJJ, Jun. 17-21, 2017, 16 pages.

Verma et al., "Porosity and Permeability Estimation using Neural Network Approach from Well Log Data," GeoConvention 2012: Vision, 2012, 6 pages.

Vollrath et al., "Fluorescence imaging of cancer tissue based on metal-free polymeric nanoparticles—a review," J. Mater. Chem. B, Mar. 2013, 1(15):1994-2007, 15 pages.

Wilt et al., "Monitoring a Water Flood of Moderate Saturation Changes with Crosswell Electromagnetics (EM): A Case Study from Dom Joao Brazil," Paper presented at the SEG Las Vegas 2012 Annual Meeting, 2012; 4 pages.

Zhang et al., "Petrophysical Inversion of Resistivity Logging Data," SPE-63285-MS, Society of Petroleum Engineers (SPE), presented at the 2000 SPE Annual Technical Conference and Exhibition, Dallas, Texas, Oct. 1-4, 2000, 8 pages.

Zhdanov et al., "Carbonate Reservoir Rocks Show Induced Polarization Effects, Based on Generalized Effective Medium Theory", 75th EAGE Conference & Exhibition, Jun. 2013, 5 pages.

PCT International Search Report and Written Opinion in International Appln. No. PCT/IB2020/000532, dated Feb. 24, 2021, 14 pages.

PCT International Search Report and Written Opinion in International Appln. No. PCT/IB2020/000528, dated Feb. 25, 2021, 18 pages.

Abbassi et al., "Efficiency Improvements in Production Profiling Using Ultracompact Flow Array Sensing Technology," Petrophysics, Aug. 2018, 59:4 (457-488), 32 pages.

aflglobal.com [online], "MiniBend Fiber Optic Component for Downhole Double-Ended Systems and Optical Connectivity," available on or before Jun. 8, 2012, retrieved on Jun. 12, 2018, retrieved from URL: <https://www.aflglobal.com/productlist/Product-Lines/Fiber-Optic-Cable/MiniBend_for_Downhole_Double-Ended_Systems___Optic/doc/MiniBend.aspx>, 1 page.

(56) References Cited

OTHER PUBLICATIONS

Ali et al., "Constraining Interwell Water Flood Imaging with Geology and Petrophysics: An Example from the Middle East," Paper presented at the 2009 SPE Middle East Oil & Gas Show and Conference, Bahrain, Mar. 15-18, 2009, SPE 120558; 11 pages.
Alkhatib et al., "Robust Quantification of Uncertainty in Heterogeneity for Chemical EOR Processes: Applying the Multi-Level Monte Carlo Method," SPE-172635-MS, Society of Petroleum Engineers (SPE), presented at the SPE Middle East Oil & Gas Show and Conference, Bahrain, Mar. 8-11, 2015, 13 pages.
Allard et al., "Core-shell type dually fluorescent polymer nanoparticles for ratiometric pH-sensing," J. Polym. Sci., Part A: Polym. Chem., 2008, 46(18):6206-6213, 8 pages.
Alsaif et al., "Petrophysical Joint Inversion for Reservoir Saturation Mapping: A Case Study," SPE-188143-MS, Society of Petroleum Engineers (SPE), presented at the SPE Kingdom of Saudi Arabia Annual Technical Symposium and Exhibition held in Dammam, Saudi Arabia, Apr. 24-27, 2017, 7 pages.
Al-Shehri et al., "Illuminating the Reservoir: Magnetic NanoMappers," SPE 164461, Society of Petroleum Engineers (SPE), presented at the SPE Middle East Oil and Gas Show and Exhibition on Mar. 10-13, 2013, 10 pages.
Bakulin et al., "Smart DAS upholes for near surface model building and deep imaging with vertical arrays," International Conference on Engineering Geophysics, Oct. 2017, 5 pages.
Behnke et al., "Encapsulation of Hydrophobic Dyes in Polystyrene Micro- and Nanoparticles via Swelling Procedures," J. Fluoresc., 2011, 21(3):937-944, 8 pages.
Bennetzen et al., "Novel Applications of Nanoparticles for Future Enhanced Oil Recovery", IPTC-17857-MS, presented at the International Petroleum Technology Conference (IPTC), Dec. 10-12, 2014, 14 pages.
Brie et al., "Shear Sonic Interpretation in Gas-Bearing Sands," SPE 30595, Society of Petroleum Engineers (SPE), presented at the SPE Annual Technical Conference and Exhibition, Oct. 22-25, 1995, 10 pages.
Burtman et al, "Experimental Study of Induced Polarization Effect in Unconventional Reservoir Rocks," Geomaterials 04:04, Jan. 1, 2014, 13 pages.
Carey et al., "Analysis of water hammer signatures for fracture diagnostics," Presented at the SPE Annual Technical Conference and Exhibition, Society of Petroleum Engineers, Jan. 2015, 26 pages.
Chaki et al., "Well Tops Guided Prediction of Reservoir Properties using Modular Neural Network Concept: A Case Study from Western Onshore, India," Indian Institute of Technology, 24 pages.
Cheng et al., "Comparison of Q-estimation methods: an update," Q-estimation, CREWES Research Report, vol. 25, 2013, 38 pages.
Cheng et al., "Estimation of Q: a comparison of different computational methods," Integration geoConvention 2013, Geoscience Engineering Partnership, 4 pages.
Davydycheva et al, "Electrical-Prospecting Method for Hydrocarbon Search Using the Induced-Polarization Effect," Geophysics, Society of Exploration Geophysicists, 71:4, Jul. 1, 2006, 11 pages.
Deschamps et al., "Drilling to the Extreme: the Micro-Coring Bit Concept," IADC/SPE 115187, International Association of Drilling Contractors (IADC), Society of Petroleum Engineers (SPE), presented at the IADC/SPE Asia Pacific Drilling Technology Conference and Exhibition, Aug. 25-27, 2008, 12 pages.
Desmette et al., "Drilling Hard and Abrasive Rock Efficiently, or Generating Quality Cuttings? You No Longer Have to Choose . . . ," SPE 116554, Society of Petroleum Engineers (SPE), 2008 SPE Annual Technical Conference and Exhibition, Sep. 21-24, 2008, 19 pages.
Dunham et al., "Hydraulic fracture conductivity inferred from tube wave reflections," In SEG Technical Program Expanded Abstracts 2017 (pp. 947-952). Society of Exploration Geophysicists, 6 pages.
Georgi, et al., "Advances in Cuttings Collection and Analysis," SPWLA 34th Annual Logging Symposium, Jun. 13-16, 1993, 20 pages.
Giles, "Multilevel Monte Carlo path simulation," Operations Research, 56:3 (607-617), May-Jun. 2008.
gpxsurveys.com.au [online], "Ground Geophysics Induced Polarisation", available on or before Mar. 10, 2015, [retrieved Mar. 10, 2015], retrieved from URL: <http://www.gpxsurveys.com.au/Ground-Geophysics/Induced-Polarisation>, 2 pages.
Kumar et al., "Petrophysical evaluation of well log data and rock physics modeling for characterization of Eocene reservoir in Chandmari oil field of Assam-Arakan basin, India," J Petrol Explor Prod Technol, 2018, 8: 323-340.
Li et al., "A Comparative Study of the Probabilistic-Collocation and Experimental-Design Methods for Petroleum-Reservoir Uncertainty Quantification," SPE Journal, 16:2 (429-439), Jun. 2011.
Liang et al., "Crosswell Electromagnetic Inversion Constrained by the Fluid-Flow Simulator," Paper presented at the SPE Annual Technical Conference and Exhibition, Florence, Italy, Sep. 19-22, 2010; 11 pages.
Liang et al., "Hydraulic fracture diagnostics from Krauklis-wave resonance and tube-wave reflections," Geophysics, 82(3): D171-D186, May-Jun. 2017, 16 pages.
Marsala et al., "3D inversion practice for crosswell electromagnetic surveys in horizontal wells in Saudi Arabia," 85th Annual International Meeting, SEG, 2015; 4 pages.
Marsala et al., "Crosswell electromagnetic induction between two widely spaced horizontal wells: Coiled-tubing conveyed data collection and 3D inversion from a carbonate reservoir in Saudi Arabia," 85th Annual International Meeting, SEG, 2015; 4 pages.
Marsala et al., "Crosswell Electromagnetic Tomography: from Resistivity Mapping to Interwall Fluid Distribution", IPTC 12229-PP, presented at the International Petroleum Technology Conference (IPTC) on Dec. 3-5, 2008, 6 pages.

* cited by examiner

GEOSTEERING IN DIRECTIONAL DRILLING

CROSS-REFERENCE TO RELATED APPLICATION(S)

This application is a U.S. National Phase Application under 35 U.S.C. § 371 and claims the benefit of priority to International Application Serial No. PCT/IB2020/000532, filed May 26, 2020, the contents of which are hereby incorporated by reference.

BACKGROUND

The production of crude oil and other hydrocarbons starts with the drilling of a wellbore into a hydrocarbon reservoir. In many cases, the hydrocarbon reservoir is a narrow layer of material in the subterranean environment, making efficient targeting of the wellbore important for productivity. Accordingly, directional drilling is often used to direct a drill bit to form a wellbore in the reservoir layer.

Drilling may be performed by a rotating drill string, which uses the rotation of the drill string to power a bit to cut through subterranean layers. Changing the orientation of the bit for directional drilling may be performed using a mud motor, for example, by stopping the rotation of the drill string, and activating the mud motor to power the drill bit while the drill string is slid forward down the well, while a bent section of the bottom hole assembly orients the drill string in a new direction. Any number of other techniques have been developed to perform directional drilling.

More recent developments have been in the use of coiled tubing drilling for directional drilling. Directional drilling using coiled tubing may be performed by a mud motor used with hydraulic actuators to change the direction of the bit.

Controlling the direction of the drill string in directional drilling, termed geosteering herein, may be done using any number of techniques. In early techniques, drilling was halted and downhole instrumentation, coupled to the surface by a wireline, was lowered into the wellbore. The wireline instrumentation was used to collect information on the inclination of the end of the wellbore and a magnetic azimuth of the end of the wellbore. This information was used in concert with the depth of the end of the wellbore, for example, measured by the length of the wireline or drill string, to determine the location of the end of the wellbore at a point in time, termed a survey. Collection of a number of surveys was needed to determine the changes needed in drilling operations for geosteering a wellbore to a reservoir layer.

Developments have continued on wireline instrumentation for logging. For example, U.S. Pat. No. 8,726,983 describes a method and apparatus for performing wireline logging operations in an underbalanced well. Well logging equipment is installed while holding the underbalanced open hole at its optimal pressure. The locking string is conveyed on a drill string to total depth and logging, while removing the logging string. However, this reference does not discuss logging while drilling.

SUMMARY

An embodiment described herein provides a method for geosteering in coiled tubing directional drilling. The method includes measuring a response from a gas sensor disposed on a bottom hole assembly and determining a gas parameter from the response. A trend in the gas parameter is determined. Adjustments to geosteering vectors for the bottom hole assembly are determined based, at least in part, on the gas parameter, the trend, or both.

Another embodiment described herein provides a system for geosteering in coiled tubing directional drilling. The system includes a coiled tubing drilling apparatus including a bottom hole assembly including a mandrel and a drill bit. A gas sensor is disposed on the mandrel to measure a parameter of fluid flowing outside the mandrel.

DETAILED DESCRIPTION

Figure 1:
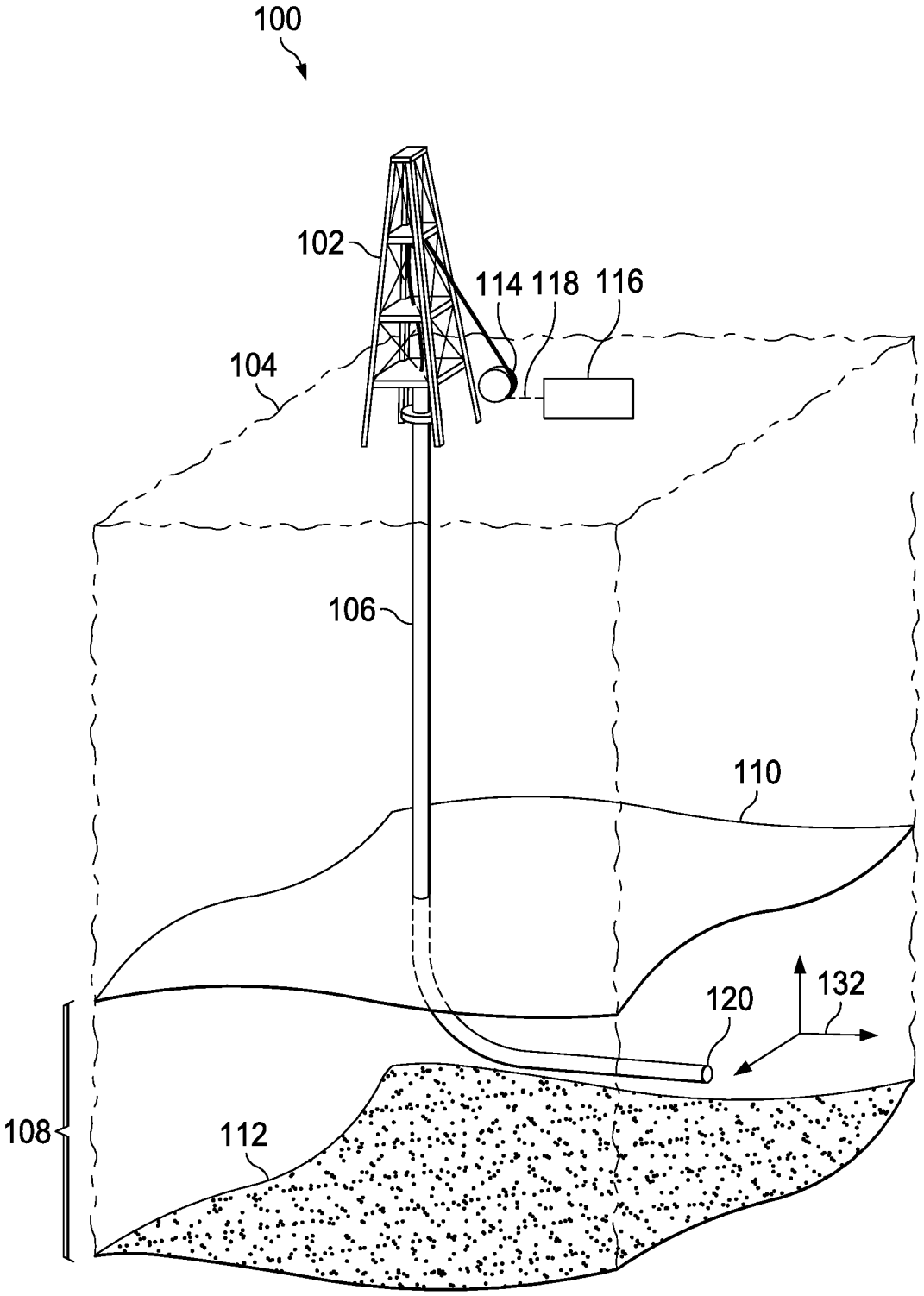
FIG. 1 is a schematic drawing of a method for geosteering a well during directional drilling using gas sensors.

Production Logging (PLT) is one of the key technologies to measure fluid properties in the oil industry. If this is done while drilling, termed logging while drilling (LWD) herein, the measured data can be used in to support drilling operations. The data collected in the LWD may be retrieved from the well by pulling the coiled tubing from the well and downloading data from memory chips that have stored the data. In other examples the data may be sent to the surface through but pulse telemetry, wireline connections, or other techniques. This is termed measurement while drilling (MWD) herein. Generally, LWD is used to describe both concepts herein.

The data may be used to geosteer the wells, e.g., direct the drilling trajectory using hydrocarbon production information. This may allow the well to be targeted inside the most prolific reservoir layers. In some applications, the log data from the LWD may be used to change the trajectory of the wells once it is analyzed. In other applications, the data collected in real time from the MWD may be used to either automate the trajectory control, or to provide information to an operator to change the trajectory if needed.

Coiled tubing may be used to drill wellbores in an underbalanced condition, in which the pressure in the formation is lower than the pressure in the wellbore. This may be performed by using a sealed surface system that allows the coiled tubing to pass through while sealing around it and diverting fluids flowing into the wellbore. Drilling in an underbalanced condition protects the reservoir from damage due to drilling fluids, leak off, and other conditions as fluids, including gas, are flowing into the wellbore during the drilling process. In drilling of gas wells in underbalanced conditions, gas from the formation is flowing in the annulus, i.e., the region in the wellbore between the logging tool and the rock formation. This allows the use of the LWD/MWD techniques described herein.

Provided herein are LWD/MWD techniques that allow the measurement and evaluation of the gas produced inside the borehole, thanks to a tool assembly that includes different sensors. The data collected supports geosteering in more productive gas or oil layers of a reservoir. The techniques also relate to measurements of multiphasic flows in oil and gas wells at downhole conditions. Production Logging (PL), including LWD and MWD of oil and gas wells has numerous challenges related to the complexity of multiphasic flow conditions and severity of downhole environment.

In particular, gas, oil, water, and mixtures flowing in wells, will present bubbles, droplets, mist, segregated wavy, slugs, and other structures depending on relative proportions of phases, their velocities, densities, viscosities, as well as pipe dimensions and well deviations. Accordingly, in order to understand the phases and phase behavior, a number of gas parameters must be measured, including, for example, flowrates, bubble contents, water content, and the like.

The wellbores provide an aggressive environment that may include high pressures, for example, up to 2000 bars, high temperature, for example, up to 200° C., corrosivity from $H_2S$ and $CO_2$, and high impacts. These environmental conditions place constraints on sensors and tool mechanics. Further, solids present in flowing streams, such as cuttings and produced sand, can damage equipment. In particular, sand entrained from reservoir rocks will erode parts facing flow. Solids precipitated from produced fluids due to pressure and temperature changes, such as asphalthenes, paraffins, or scales create deposits that can contaminate sensors and or blocking moving parts, such as spinners. Cost is also an important parameter in order to provide an economically viable solution to well construction optimization.

FIG. 1 is a schematic drawing of a method 100 for geosteering a well during directional drilling using gas sensors. In the method 100, a drilling rig 102 at the surface 104 is used to drill a wellbore 106 to a reservoir layer 108. In this illustration, the reservoir layer 108 is bounded by an upper layer 110, such as a layer of cap rock, and a lower layer 112, such as a layer containing water.

The drilling rig 102 is coupled to a roll of coiled tubing 114, which is used for the drilling. A control shack 116 may be coupled to the roll of coiled tubing 114 by a cable 118 that includes transducer power lines and other control lines. The cable 118 may pass through the coiled tubing 114, or alongside the coiled tubing 114, to the end 120 of the wellbore 106, where it couples to the BHA used for drilling the wellbore 106. In some embodiments described herein, a cable is not used as the sensor packages are powered by batteries and communicate with the surface through other techniques, such as mud pulse telemetry (MPT).

In embodiments described herein, the gas sensors measure the components and velocity of materials passing through the outer annulus of the wellbore 106, for example, measuring velocity, phases, and the like. The trend of these measurements may be used to determine whether the BHA is within a producing zone of the reservoir layer 108, has left the producing zone, or is approaching the lower layer 112. This information, along with the information on the structure of the layers 110 and 112, is used to adjust the vectors 132 to steer the wellbore 106 in the reservoir layer 108 back towards a product zone. For example, if the material flowing into the wellbore in the unbalanced drilling is increasing in water or fluids, the BHA may be approaching the lower layer 112. Other sensors, such as EM sensors, may be used to confirm the presence of the water layer. Accordingly, the vectors 132 may be adjusted to direct the BHA back towards a gas zone in the reservoir layer 108.

Figure 2:
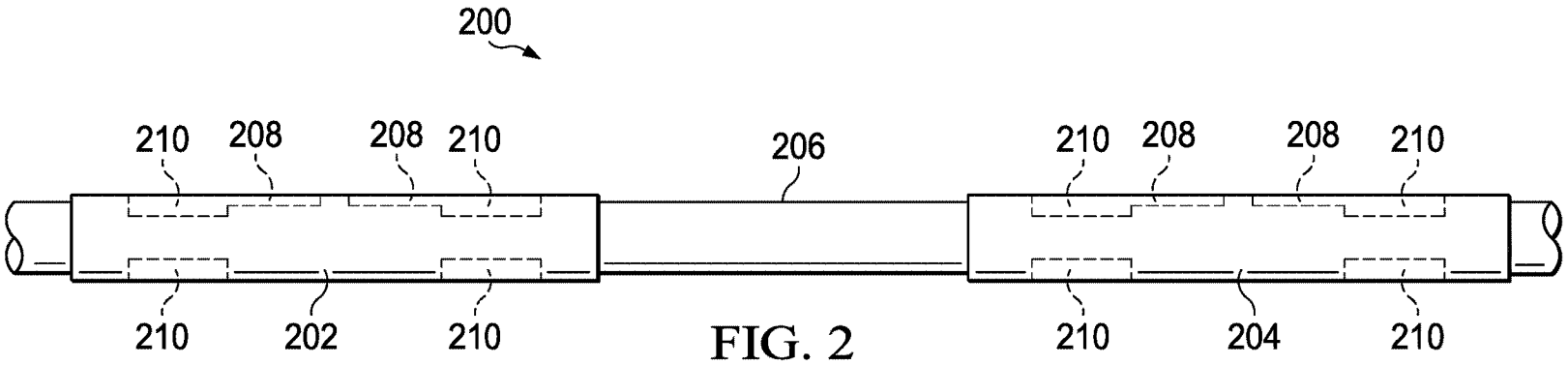
FIG. 2 is a drawing of an instrumented bottom hole assembly (BHA) that may be used for geo-steering in directional drilling in coiled tubing drilling (CTD) using gas parameter measurements.

FIG. 2 is a drawing of an instrumented bottom hole assembly (BHA) 200 that may be used for geo-steering in directional drilling in coiled tubing drilling (CTD) using gas parameter measurements. In this embodiment, the BHA 200 has two instrumented mandrels. A first mandrel 202 is located near a drilling assembly (not shown), and a second mandrel 204 is located further away from the drilling assembly, separated from the first mandrel 202 by a spacer pipe 206.

The two mandrels 202 and 204 may communicate with each other, for example, through electromagnetic signals linking radiofrequency antennae 208 on each of the mandrels 202 and 204. This enables the communication system with the surface to be installed in only one of the mandrels. For example, the second mandrel 204 may be located farther from the drillbit and may handle communications with the surface using a mud pulse telemetry system. The first mandrel 202 may be located closer to the drill bit and send data to the second mandrel 204 to be sent to the surface.

In addition to measurement trends, e.g., in time, the separations of the sensors between the first mandrel 202 and the second mandrel 206 provide a separation of measurements in space, allowing targeting to be performed based on the differences in the measurements between each mandrel 202 and 206. For example, if a higher water content is measured at the first mandrel 202 then at the second mandrel 206, it may indicate that the drillbit 204 is approaching the lower layer 112. Accordingly, the trajectory of the wellbore 106 may be adjusted to bring the drillbit 204 back into the reservoir layer 108.

Sensor packages 210 are mounted along each of the mandrels 202 and 204, for example, in embedded slots formed in the outer surface of the mandrels 202 and 204. The sensor packages 210 may include multiple sensors assembled into a single string of sensors. The sensors may include micro electro mechanical systems (MEMS) pressure sensors, temperature sensors, optical sensors, ultrasonic sensors, conductivity sensors, and the like. The sensors are available from OpenField Technologies of Paris, France (https://www.openfield-technology.com/).

Figure 3:
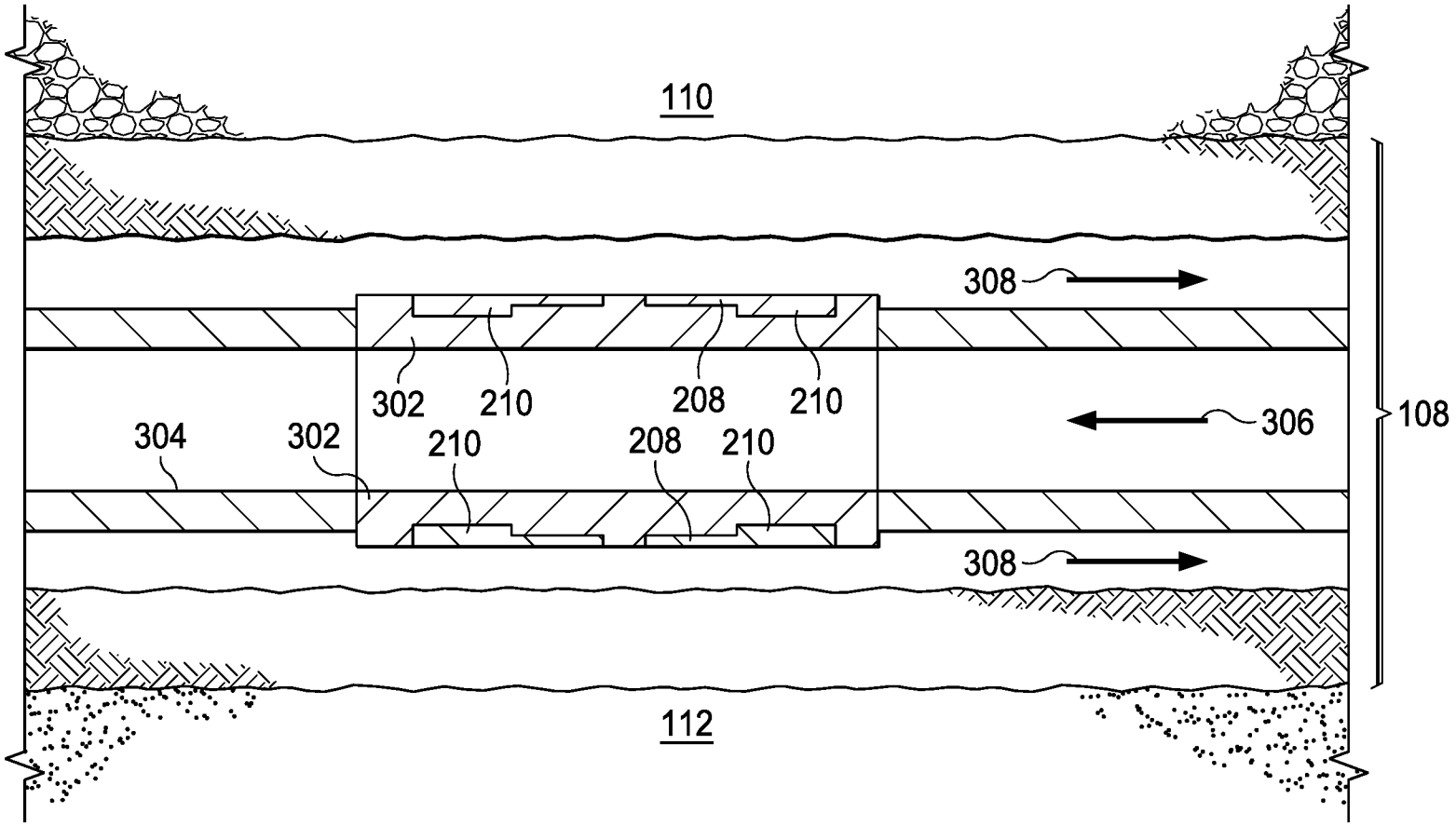
FIG. 3 is a schematic drawing of fluid flow through a sensor equipped mandrel.

FIG. 3 is a schematic drawing 300 of fluid flow through a sensor equipped mandrel 302. Like numbered items are as described with respect to FIG. 2. In a schematic drawing 300, drilling fluid 306 from the surface flows through the coil tubing line 304 in the direction of the drill bit. A mixture 308 of drilling fluid 306 and produced fluids is returned to the surface through the annulus. The produced fluids may include gas, oil, and reservoir water.

The sensor packages 210 may include an ultrasonic Doppler system to measure the velocity of fluid flow. For example, an ultrasonic transducer is oriented to emit an ultrasonic wave into the fluid flow, which is reflected off bubbles or particles to in the fluid flow. An ultrasonic detector picks up the reflected sound, and can be used to calculate the velocity from the frequency shift as particles or bubbles approach the detector. The ultrasonic Doppler system can also provide the information to determine the gas content of the two-phase stream in the annulus of the wellbore, for example, by quantitating the bubbles of an internal phase and determining their size. In some embodiments, a micro spinner is included to measure the flow velocity instead of, or in addition to, the Doppler measurement. The micro spinner may use an electrical coil or a magnet to detect spinning rate, which is proportional to the flow rate.

The sensor packages 210 may include a MEMS pressure transducer to measure pressure outside of the mandrel 202 or 204. A conductivity probe may be included to measure fluid conductivity at a high frequency, allowing a determination of hydrocarbon to water phase.

The information from the sensor packages 210 is combined with information from other geophysical measurements to assist in geosteering. For example, seismic measurements may be used to determine probable locations of boundary layers 110 and 112. As described herein, geophysical models may be generated and used with the data from the gas sensors.

Figure 4:
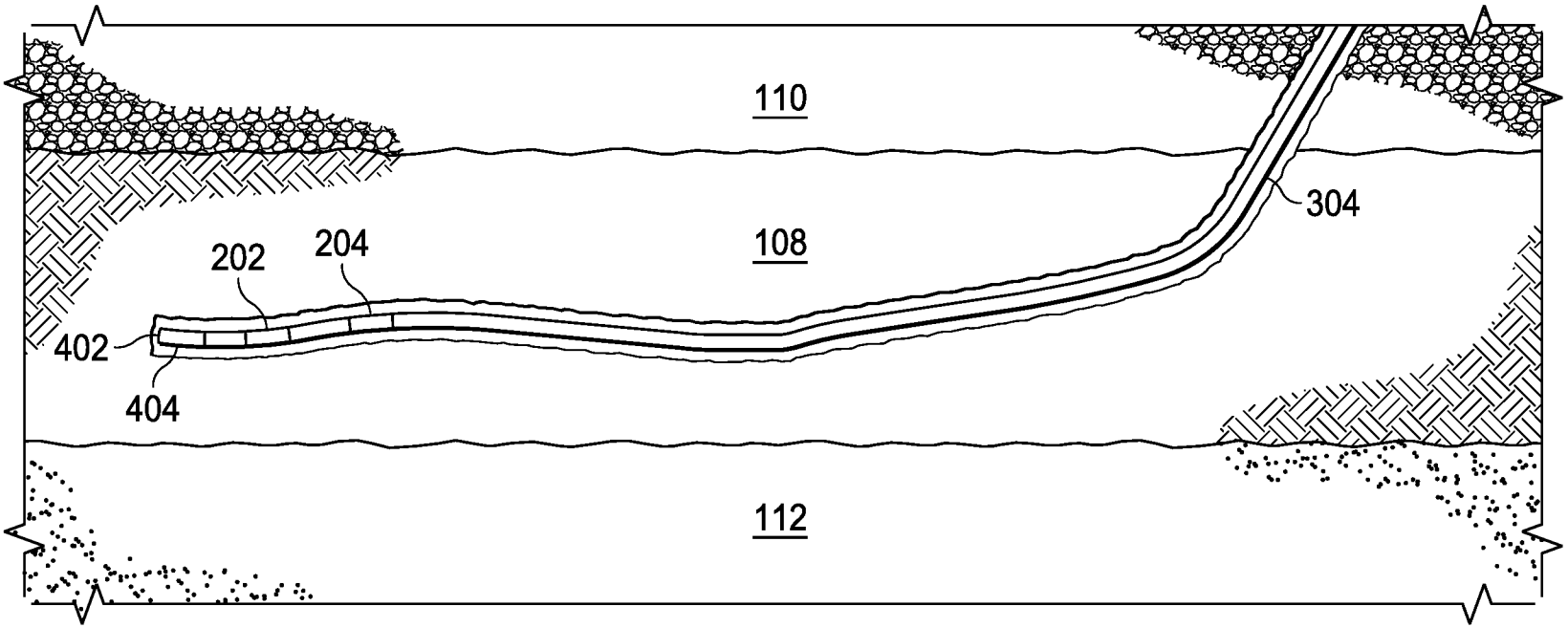
FIG. 4 is a schematic drawing of geosteering in a well.

FIG. 4 is a schematic drawing of geosteering in a well. Like numbered items are as described with respect to FIGS. 1-3. The separations of the sensors in the sensor packages 210 between the first mandrel 202 and the second mandrel 204 provide a separation of measurements in space, allowing targeting to be performed based on the differences in the measurements between each mandrel. For example, if the water measured in the mixture 308 at the first mandrel 202, closer to the drillbit 402, are higher than the water measured at the second mandrel 204, it may indicate that the drillbit 402 is leaving the reservoir layer 108. Accordingly, the trajectory of the well may be adjusted to bring the drillbit 402 back into the productive zone.

Trends over time of sensor readings at the mandrels 202 and 204 may also be used for geosteering. For example, if the water measured at the first mandrel 202 increases, this may indicate that the drillbit 402 is nearing lower layer and the leaving the reservoir layer 108. A telemetry package 404 may also be located directly behind the drillbit 402 to provide further information about the location of the drillbit 402. This may include seismic detectors and transducers that can locate the drillbit 402 in three-dimensional space. The telemetry data may be transferred back to the surface directly from the telemetry package 404, through mud pulse telemetry, fiber optical cables, or through other communications techniques. In one embodiment, the telemetry package 404 may communicate with the second mandrel 204 through electromagnetic waves and the second mandrel 204 may communicate the telemetry data to the surface, for example, through mud pulse telemetry.

Figure 5:
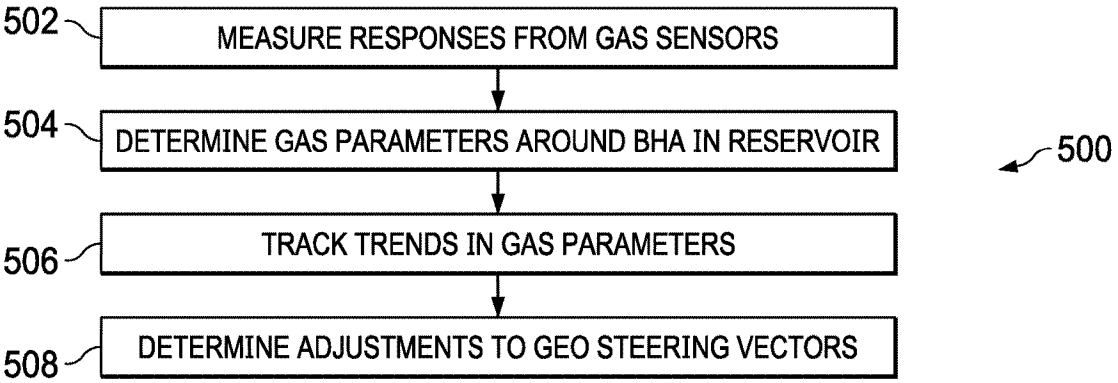
FIG. 5 is a process flow diagram of a method for using gas parameter sensors for geosteering in coiled tubing drilling.

FIG. 5 is a process flow diagram of a method 500 for using gas parameter sensors for geosteering in coiled tubing drilling. The method begins at block 502, with the measurement of response from gas sensors, for example, mounted to a mandrel. As described herein, the measurements may include pressure, temperature, flow velocity, the amount of gas in the liquid fraction of the produced fluids, and the presence of conductive fluids, among others.

At block 504, gas parameters at the BHA are determined from the measurements. At block 506, trends in the gas parameters are determined. As the measurements are quantitative, the analysis of the data during the trajectory of the drilling of the wellbore provides the information used to determine if the wellbore is being drilled in the targeted structural layer of the reservoir.

In some embodiments, the gas parameters and the trends in the gas parameters are integrated with a priori information of the area, including, for example, geological structural models and dynamic models of the area. The gas parameters and the trends in the gas parameters can also be used with other LWD or MWD measurements, such as resistivity, acoustic measurements, measurements from cuttings, or flow measurements at the surface, to assess if the wellbore is still being drilled into an economically productive reservoir layer.

At block 508, adjustments to geosteering vectors are determined. The information obtained from the combination of the gas parameters and trends in the gas parameters, along with the modeling parameters, may be used to determine adjustments to the geosteering vectors. For example, the information may indicate that the wellbore needs to be steered to the right, left, up, or down. In coiled tubing drilling, a mud motor can be used to change the direction of the drillbit, thus changing the trajectory of the wellbore. The determination of the direction to steer the drillbit is based on the tool measurements and the knowledge of the geological setting. For example, if radiofrequency (RF) sensors indicate the presence of water around the tool, this indicates that the BHA is proximate to the lower layer 112, or water aquifer, indicating that steering the drillbit upward away from the water will increase the percentage of the hydrocarbon produced.

In some examples, the information may indicate that the wellbore has left the productive zone. In some embodiments, the coil tubing is removed to allow a completely different direction to be drilled. In other embodiments, leaving the productive zone indicates that the drilling is completed and further well completion activities may be performed to begin production, such as fracturing the rock around the well environment, installing casing, cementing the casing in place, perforating the casing, or positioning of production tubing in the wellbore, and the like, depending on the production and well environment.

Figure 6:
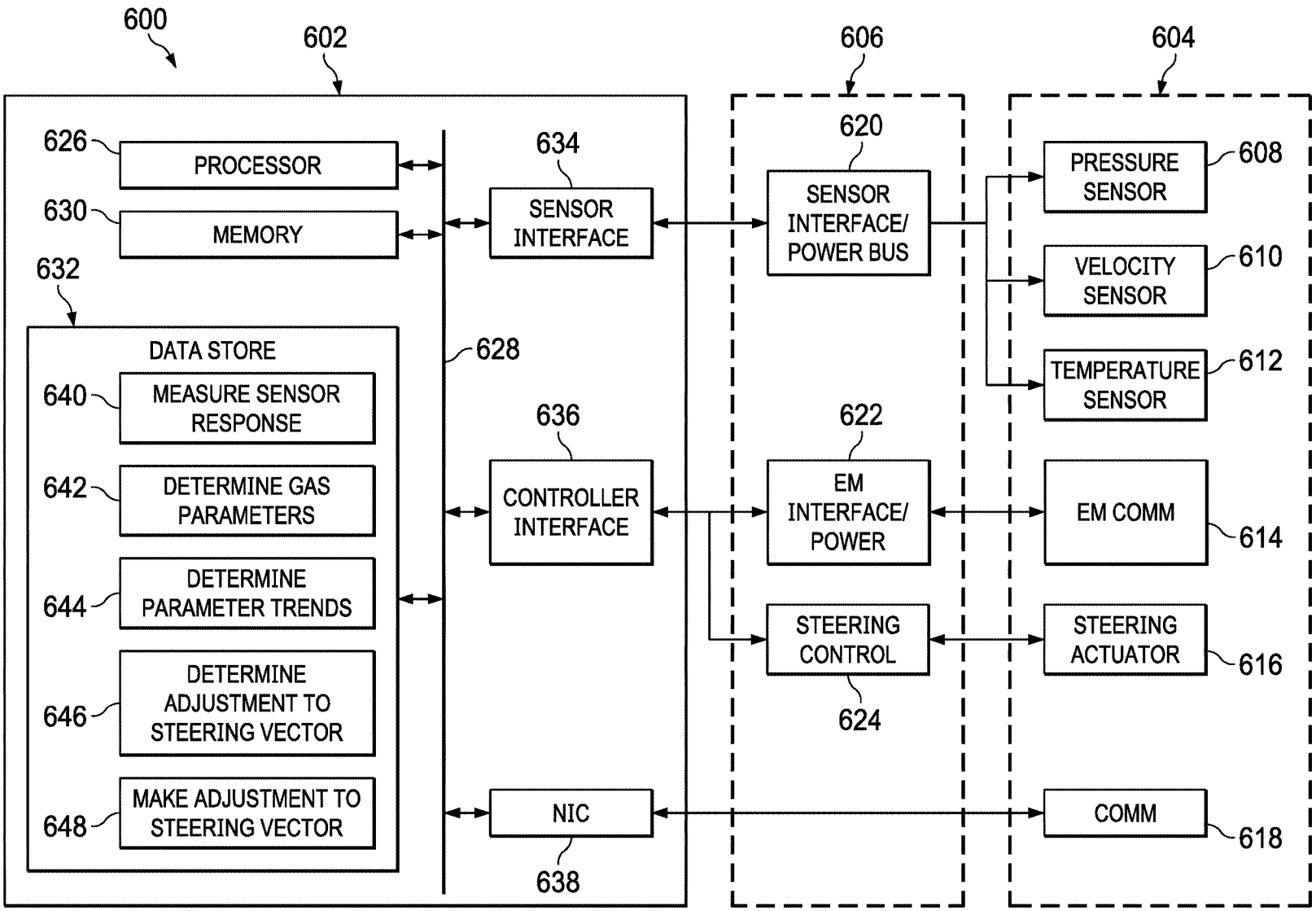
FIG. 6 is a block diagram of a system that may be used for geosteering the BHA based, at least in part, on data from gas parameters measured by sensors deployed on the BHA

FIG. 6 is a block diagram of a system 600 that may be used for geosteering the BHA based, at least in part, on data from gas parameters measured by sensors deployed on the BHA. The system 600 includes a controller 602 and BHA sensors/actuators 604 that are coupled to the controller 602 through a number of interface unit 606. In the embodiment shown in FIG. 6 the BHA sensors/actuators 604 include a pressure sensor 608, a velocity sensor 610, and a temperature sensor 612. As described herein, the pressure sensor 608 may be a MEMS sensor. The velocity sensor 610 may be In addition, the BHA sensors/actuators 604 may include an electromagnetic (EM) communications device 614, for example, used to communicate between mandrels. The EM communications device 614 may also be used for sensing the presence of water proximate to the BHA, for example, by detecting a decrease in signal strength at the receiving mandrel from the broadcasting mandrel. Further, in some embodiments, multiple antennas may be spaced around the mandrels providing directional determination of the water proximate to the BHA.

A steering actuator 616 may be a mud motor, hydraulic actuator, or other device used to redirect the drillbit. A communicator 618 may be included in the BHA 604 to allow communications with the surface. The communicator 618 may be based on mud pulse telemetry. In some embodiments, the drilling fluid is compressed gas. In these embodiments, the communicator 618, may not be present as the compressibility of the drilling fluid prevents communications through mud pulse telemetry. In other embodiments, the communicator 618 is a digital interface to a wireline or optical line coupled to equipment at the surface through the coiled tubing line.

The BHA sensors/actuators 604 are coupled to the controller 602 through a number of different sensor interfaces 606. For example, a sensor interface and power bus 620 may couple the pressure sensor 608, the velocity sensor 610, and the temperature sensor 612 to the controller 602. Further, the sensor interfaces 606 generally provide power to the individual sensors, such as from a battery or a power line to the surface.

The sensor interfaces 606 may include an electromagnetic (EM) interface and power system 622 that provides power for the EM communications device 614. The EM communications device 614 may be located in a last mandrel, e.g., farthest from the drillbit along the BHA, allowing the last mandrel to provide communications through the communicator 618 to the surface.

If present, the steering actuator 616 is powered by hydraulic lines or electric lines, for example, from the surface. In some embodiments, a steering control unit 624 provides the power or hydraulic actuation for the steering actuator 616. In other embodiments, the geo-steering is performed by other techniques, such as the inclusion of bent subs in the BHA. In yet other embodiments, the coiled tubing drilling apparatus is pulled from the wellbore to obtain log data from the controller 602, and determine the trajectory changes to make.

The controller 602 may be a separate unit mounted in the control shack 116 (FIG. 1), for example, as part of a programmable logic controller (PLC), a distributed control system (DCS), or another computer control unit used for controlling the drilling. In other embodiments, the controller 602 may be a virtual controller running on a processor in a DCS, on a virtual processor in a cloud server, or using other real or virtual processors. In one embodiment, the controller 602 is included in an instrument package attached to the BHA, for example, in a mandrel along with sensors. This embodiment may be used with gas as the drilling fluid, as communications to the surface may be limited. Further, embedding the controller 602 in the BHA may be used for LWD, in which the coiled tubing is pulled from the wellbore to retrieve the data.

The controller 602 includes a processor 626. The processor 626 may be a microprocessor, a multi-core processor, a multithreaded processor, an ultra-low-voltage processor, an embedded processor, or a virtual processor. In some embodiments, the processor 626 may be part of a system-on-a-chip (SoC) in which the processor 626 and the other components of the controller 602 are formed into a single integrated electronics package. In various embodiments, the processor 626 may include processors from Intel® Corporation of Santa Clara, California, from Advanced Micro Devices, Inc. (AMD) of Sunnyvale, California, or from ARM Holdings, LTD., Of Cambridge, England. Any number of other processors from other suppliers may also be used.

The processor 626 may communicate with other components of the controller 602 over a bus 628. The bus 628 may include any number of technologies, such as industry standard architecture (ISA), extended ISA (EISA), peripheral component interconnect (PCI), peripheral component interconnect extended (PCIx), PCI express (PCIe), or any number of other technologies. The bus 628 may be a proprietary bus, for example, used in an SoC based system. Other bus technologies may be used, in addition to, or instead of, the technologies above. For example, the interface systems may include $I^2C$ buses, serial peripheral interface (SPI) buses, Fieldbus, and the like.

The bus 628 may couple the processor 626 to a memory 630, such as RAM, ROM, and the like. In some embodiments, such as in PLCs and other process control units, the memory 630 is integrated with a data store 632 used for long-term storage of programs and data. The memory 630 include any number of volatile and nonvolatile memory devices, such as volatile random-access memory (RAM), static random-access memory (SRAM), flash memory, and the like. In smaller devices, such as PLCs, the memory 630 may include registers associated with the processor itself. The data store 632 is used for the persistent storage of information, such as data, applications, operating systems, and so forth. The data store 632 may be a nonvolatile RAM, a solid-state disk drive, or a flash drive, among others. In some embodiments, the data store 632 will include a hard disk drive, such as a micro hard disk drive, a regular hard disk drive, or an array of hard disk drives, for example, associated with a DCS or a cloud server.

The bus 628 couples the processor 626 to a sensor interface 634. The sensor interface 634 is a data interface that couples the controller 602 to the sensor interface and power bus 620. In some embodiments, the sensor interface 634 and the sensor interface and power bus 620 are combined into a single unit, such as in a universal serial bus (USB).

The bus 628 also couples the processor 626 to a controller interface 636. The controller interface 636 may be an interface to a plant bus, such as a Fieldbus, an $I^2C$ bus, an SPI bus, and the like. The controller interface 636 may provide the data interface to the electromagnetic interface and power system 622.

The bus 628 couples the processor 626 to a network interface controller (NIC) 638. The NIC 638 couples the controller 602 to the communicator 618, for example, if the controller 602 is located in the BHA 604.

The data store 632 includes a number of blocks of code that, when executed, direct the processor to carry out the functions described herein. The data store 632 includes a code block 640 to instruct the processor to measure the sensor responses, for example, from the pressure sensor 608, the velocity sensor 610, and the temperature sensor 612. The instructions of the code block 640 may also instruct the processor 626 to determine the presence of water proximate to the BHA using the EM communications device 614.

The data store 632 may include a code block 642 to instruct the processor 626 to determine gas parameters from the measurements, including, for example, the flow rate of fluids through the annulus of the wellbore, the water content of the fluids flowing through the wellbore, and the proximity of the bottom hole apparatus. The gas parameters may also include the change, or delta, between the parameters measures at a first mandrel and the parameters measured at a second mandrel.

The data store 632 may include a code block 642 to instruct the processor 626 to determine gas parameters from the measurements. As described herein, the gas parameters may include hydrocarbon content of flowing fluids, gas content in flowing fluids, flow velocity, and the like. The determination is made for each mandrel, if more than one is present, and a difference between the measurements for the mandrels is calculated. A code block 644 is included to instruct the processor 632 to determine trends in the gas parameters.

The data store 632 may include a code block 646 to instruct the processor 626 to determine adjustments to the steering vector based on the measurements, trends, and geophysical data. A code block 648 may be included to direct the processor 632 to automatically make the adjustments to the steering vector, for example, if the drilling fluid is a gas that makes communications to the surface difficult by mud pulse telemetry.

An embodiment described herein provides a method for geosteering in coiled tubing directional drilling. The method includes measuring a response from a gas sensor disposed on a bottom hole assembly and determining a gas parameter from the response. A trend in the gas parameter is determined. Adjustments to geosteering vectors for the bottom hole assembly are determined based, at least in part, on the gas parameter, the trend, or both.

In an aspect, the method includes drilling a wellbore in an underbalanced condition using a coiled tubing drilling apparatus. In an aspect, the method includes measuring temperature.

In an aspect, the method includes measuring a hydrocarbon content in a two phase stream. In an aspect, the hydrocarbon content is measured by measuring a conductivity of a fluid in a wellbore.

In an aspect, the method includes measuring a gas content in a two-phase stream. In an aspect, the gas content is measured by quantifying a size and a number of bubbles using an ultrasonic technique.

In an aspect, the method includes measuring flow velocity. In an aspect, the flow velocity is measured by an ultrasonic Doppler system. In an aspect, the flow velocity is measured by a micro spinner.

In an aspect, the method includes measuring pressure. In an aspect, the pressure is measured by a microelectromechanical system (MEMS).

Another embodiment described herein provides a system for geosteering in coiled tubing directional drilling. The system includes a coiled tubing drilling apparatus including a bottom hole assembly including a mandrel and a drill bit. A gas sensor is disposed on the mandrel to measure a parameter of fluid flowing outside the mandrel.

In an aspect, the system includes a sealed surface system to allow the coiled tubing drilling apparatus to drill in an underbalanced configuration.

In an aspect, the gas sensor includes a pressure sensor. In an aspect, the pressure sensor includes a micro electro mechanical system.

In an aspect, the gas sensor includes a velocity sensor. In an aspect, the velocity sensor comprises a Doppler system, includes an ultrasonic transducer and an ultrasonic detector. In an aspect, the gas sensor includes a temperature sensor. In an aspect, the gas sensor includes a conductivity detector.

In an aspect, the system includes an electromagnetic communications device. In an aspect, the system includes a mud pulse telemetry system. In an aspect, the system includes a steering actuator to change a direction of the bottom hole assembly.

In an aspect, the system includes a controller. The controller includes a processor and a data store. The data store includes instructions that, when executed, direct the processor to measure a response from the gas sensor and determine a gas parameter from the response. An adjustment to a steering vector is determined based, at least in part, on the gas parameter, the trend in the gas parameter, or both.

In an aspect, the data store comprises instructions that, when executed, direct the processor to make adjustments to the steering vector.

Other implementations are also within the scope of the following claims.

What is claimed is:

1. A method for geosteering in coiled tubing directional drilling, comprising:

measuring a response from a gas sensor disposed on a bottom hole assembly, wherein the sensor comprises an ultrasonic Doppler system;

determining a gas parameter from the response, wherein the gas parameter comprises a quantification of bubbles and a size of the bubbles;

determining a trend in the gas parameter, wherein the trend corresponds to a change in water content of fluids in a wellbore over time; and determining adjustments to geosteering vectors for the bottom hole assembly based, at least in part, on, the trend, wherein the adjustments to the geosteering vectors are to bring a drill bit back into a productive zone.

2. The method of claim 1, further comprising drilling the wellbore in an underbalanced condition using a coiled tubing drilling apparatus.

3. The method of claim 1, further comprising measuring temperature.

4. The method of claim 1, further comprising measuring a hydrocarbon content in a two phase stream.

5. The method of claim 4, wherein the hydrocarbon content is measured by measuring a conductivity of a fluid in the wellbore.

6. The method of claim 1, further comprising measuring a gas content in a two-phase stream.

7. The method of claim 1, further comprising measuring flow velocity.

8. The method of claim 7, wherein the flow velocity is measured by the ultrasonic Doppler system.

9. The method of claim 7, wherein the flow velocity is measured by a micro spinner.

10. The method of claim 1, further comprising measuring pressure.

11. The method of claim 10, wherein the pressure is measured by a microelectro mechanical system (MEMS).

12. A system for geosteering in coiled tubing directional drilling, comprising:

a coiled tubing drilling apparatus comprising:

a bottom hole assembly comprising a mandrel;

a drill bit; and a steering actuator; and a gas sensor disposed on the mandrel to measure a parameter of fluid flowing outside the mandrel, wherein the sensor comprises an ultrasonic Doppler system, comprising an ultrasonic transducer and an ultrasonic detector; and a controller comprising:

a processor; and a data store, wherein the data store comprises instructions to direct the processor to:

measure a response from the gas sensor;

determine a gas parameter from the response, wherein the gas parameter comprises a quantification of bubbles and a size of the bubbles;

determine a trend in the gas parameters, wherein the trend comprises a water content of fluid flowing in a wellbore over time;

determine adjustments to a steering vector for the steering actuator based, at least in part, on the trend, wherein the adjustments to the geosteering vectors are to bring the drill bit back into a productive zone.

13. The system of claim 12, further comprising a sealed surface system to allow the coiled tubing drilling apparatus to drill in an underbalanced configuration.

14. The system of claim 12, wherein the gas sensor comprises a pressure sensor.

15. The system of claim 14, wherein the pressure sensor comprises a micro electro mechanical system.

16. The system of claim 12, wherein the gas sensor comprises a velocity sensor.

17. The system of claim 12, wherein the gas sensor comprises a temperature sensor.

18. The system of claim 12, wherein the gas sensor comprises a conductivity detector.

19. The system of claim 12, further comprising an electromagnetic communications device.

20. The system of claim 12, further comprising a mud pulse telemetry system.

21. The system of claim 12, further comprising the steering actuator to change a direction of the bottom hole assembly.

* * * * *